US006676251B1

(12) United States Patent
Kamp

(10) Patent No.: US 6,676,251 B1
(45) Date of Patent: Jan. 13, 2004

(54) LIQUID CONTAINMENT AND DISPENSING DEVICE WITH IMPROVED RESISTANCE TO SHOCK LOADS

(75) Inventor: David C. Kamp, Grand Rapids, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 882 days.

(21) Appl. No.: 08/892,131

(22) Filed: Jul. 14, 1997

(51) Int. Cl.[7] ..... B41J 2/175
(52) U.S. Cl. ..... 347/86
(58) Field of Search ..... 347/84, 85, 86, 347/87; 118/268; 206/204

(56) References Cited

U.S. PATENT DOCUMENTS

| | | | | | |
|---|---|---|---|---|---|
| 4,017,871 | A | * | 4/1977 | Hubbard | 347/87 |
| 4,556,012 | A | * | 12/1985 | Scrudato | 118/268 |
| 4,677,447 | A | | 6/1987 | Nielsen | 347/87 |
| 5,153,612 | A | | 10/1992 | Dunn et al. | 347/87 |
| 5,231,416 | A | * | 7/1993 | Terasawa et al. | 347/87 |
| 5,492,251 | A | | 2/1996 | Albini et al. | 222/153.13 |
| 5,667,063 | A | * | 9/1997 | Abe | 206/204 |
| 5,721,576 | A | * | 2/1998 | Barinaga | 347/85 |
| 5,734,401 | A | * | 3/1998 | Clark et al. | 347/86 |

FOREIGN PATENT DOCUMENTS

| | | | |
|---|---|---|---|
| EP | 0 741 038 | A2 | 6/1996 |
| JP | 93404 | A1 | 8/1978 |
| JP | 231759 | A1 | 10/1987 |
| JP | 108047 | | 4/1989 |
| JP | 76032 | A1 | 6/1990 |
| JP | 131643 | A1 | 5/1993 |
| JP | 254143 | A1 | 10/1993 |
| JP | 232437 | A1 | 9/1995 |

* cited by examiner

*Primary Examiner*—Anh T.N. Vo

(57) ABSTRACT

An ink containment and dispensing device for an ink-jet printer is provided with a main reservoir in the form of a flexible pouch, which is typically maintained at ambient pressure. The main reservoir is coupled to a variable volume chamber via a one-way valve which allows the flow of ink from the reservoir to the chamber and prevents the flow of ink from the chamber to the reservoir. The chamber is coupled to a fluid outlet, which is normally closed to prevent the flow of outward ink. However, when the ink supply is installed in a printer, the fluid outlet establishes a fluid connection between the chamber and the printer. The chamber is part of a pump provided with the ink supply that can be actuated to supply ink from the reservoir to the printer. The pump has a linearly acting pumping member and a flexible diaphragm that overlies the pumping member, the diaphragm being impervious to the transmission of oxygen and moisture therethrough to prevent degradation of the ink within the chamber.

6 Claims, 10 Drawing Sheets

LIQUID CONTAINMENT AND DISPENSING DEVICE WITH IMPROVED RESISTANCE TO SHOCK LOADS

CROSS-REFERENCE TO RELATED APPLICATION

This application is directed to improvements in the invention disclosed in co-pending U.S. patent application Ser. No. 08/429,987, now U.S. Pat. No. 5,784,087 an application in which I am named as a joint inventor.

FIELD OF THE INVENTION

This invention relates to a liquid containment device with a self-contained pump for dispensing liquid in small doses of a predetermined volume. More particularly, this invention relates to a replaceable containment device of the foregoing character that is useful in an ink-jet printer for containing a supply of printing ink and for dispensing the printing ink to a printing head upon the actuation of the self-contained pump.

BACKGROUND AND BRIEF DESCRIPTION OF THE INVENTION

A pending U.S. patent application filed by Bruce Cowger and Norman Pawlowski, Jr. for an invention entitled "Ink Supply For An Ink-Jet Printer," describes an ink supply for an ink-jet printer that is separate from the printer ink pen, and can be replaced upon the emptying of the ink supply without the need to replace the printer ink pen. The ink supply of the aforesaid U.S. patent application incorporates a self-contained pumping device for dispensing ink from a pumping chamber, and describes, as an embodiment of such a pumping device, a bellows pump. However, a bellows pump requires a relatively large extended surface of a semi-rigid material, such as a polymeric material, and is subject to a relatively high rate of oxygen and moisture transfer through the material of the bellows. This oxygen and/or moisture transfer can result in the degradation of the ink within the ink supply, especially in a printer that is used only infrequently. Further, the bellows is subject to leakage at the location of its attachment to another portion of the ink supply. According to the aforesaid pending U.S. patent application Ser. No. 08/429,987, these and other problems associated with the use of a bellows can be avoided by the use of a pumping device having a rigid perimetrical wall, preferably formed integrally with the associated chassis structure of the ink supply, with a linearly acting pumping member that is moveable within a pumping chamber defined by the rigid wall to pressurize ink within the pumping chamber, and a flexible moisture and oxygen barrier film heat sealed to an edge of the perimetrical wall in a continuous pattern and overlying the pumping member.

An ink supply according to the aforesaid U.S. patent application Ser. No. 08/429,987 also has a generally cup-shaped outer shell of a fairly rigid polymeric material, preferably a material with translucent properties to permit inspection of the contents thereof, which is used to contain and protect a flexible, ink-containing pouch. The outer shell is generally rectangular in cross-section, with an opposed pair of very long sides and an opposed pair of very short sides, the configuration of the shell being determined by the design of a docking station of the printer into which the ink supply is to be inserted when it is in position for the dispensing of ink therefrom. In such an arrangement, it has been found to be desirable to encircle the ink-containing pouch within a perimetrical frame whose sides have sufficient rigidity to protect the ink-containing pouch from impact and shock loads. The perimetrical frame, however, occupies space within the outer shell unless the frame and shell are so designed, in accordance with the present invention, that portions of the legs of the frame project into, or through, adjacent portions of the outer shell.

In an ink supply according to the aforesaid pending U.S. patent application Ser. No. 08/429,987, there is also provided a chassis to be affixed to the open end of the shell. This chassis, which houses the pump of the ink supply and has a fluid outlet for the dispensing of ink from the ink supply, must be secured to the shell in such a way that it cannot be readily accidentally disengaged therefrom as a result of shock or impact loads. For maintaining resistance to accidental disengagement of any of the elements of the ink supply, namely the shell, the chassis and the cap, from one another, it has been found useful to insert both the chassis and the cap into the shell, with the chassis captured between the cap and the shell.

An ink supply according to the aforesaid pending U.S. patent application Ser. No. 08/429,987 also incorporates a cap of a complex configuration that is secured to the polymeric chassis, after the chassis and the flexible pouch, which is attached to the chassis, is secured to the shell with the flexible pouch contained within the shell. Because of the complexity of the cap, it is preferably formed integrally in a single piece from a polymeric material by injection molding. In any case, it is preferred that the attachment of the cap to the chassis be tamper resistant, which requires a relatively high degree of permanency to such attachment. It has now been found that, in an ink supply with a chassis buried in the shell between the cap and the shell, it is beneficial to sonically weld the cap to the shell, and this can be done by providing the cap with one or more ledges, which act as energy users.

Accordingly, it is an object of the present invention to provide an improved liquid containing and dispensing device. More particularly, it is an object of the present invention to provide an improved device of the foregoing character that is useful in containing and dispensing ink in an ink-jet printer.

It is also an object of the present invention to provide a liquid containment and dispensing device with an improved volumetric efficiency. More particularly, it is an object of the present invention to provide an improved device of the foregoing character that is useful in containing and dispensing ink in an ink-jet printer.

It is also an object of the present invention to provide a printing ink containment and dispensing device having improved resistance to disengagement of the elements thereof under shock or impact load.

It is also an object of the present invention to provide a printing ink containment and dispensing device with good tamper indicating properties.

For a further understanding of the present invention and the objects thereof, attention is directed to the drawing and the following brief description thereof, to the detailed description of the preferred embodiment of the invention, and to the appended claims.

DETAILED DESCRIPTION OF THE PREFERRED EMBODIMENT

Figure 1:
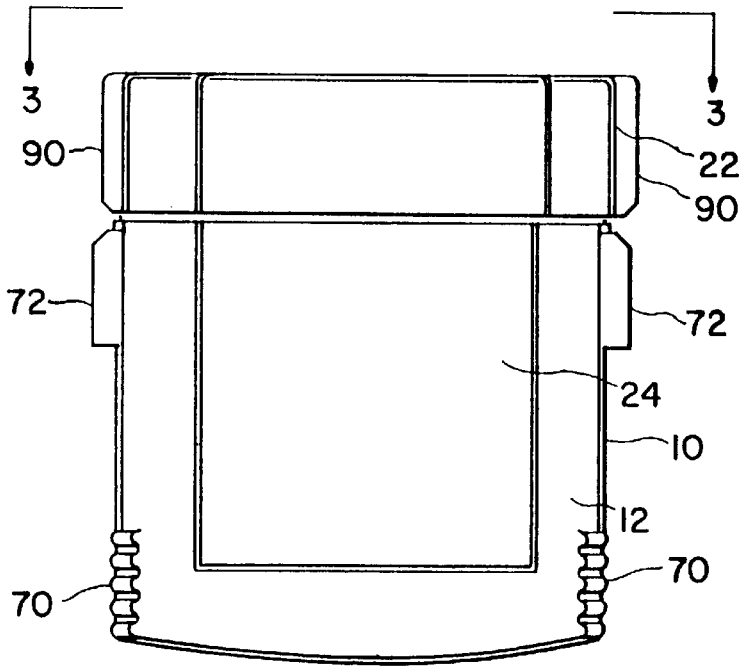
FIG. 1 is a side view of a liquid containment and dispensing device according to an embodiment of the present invention.
Figure 2:
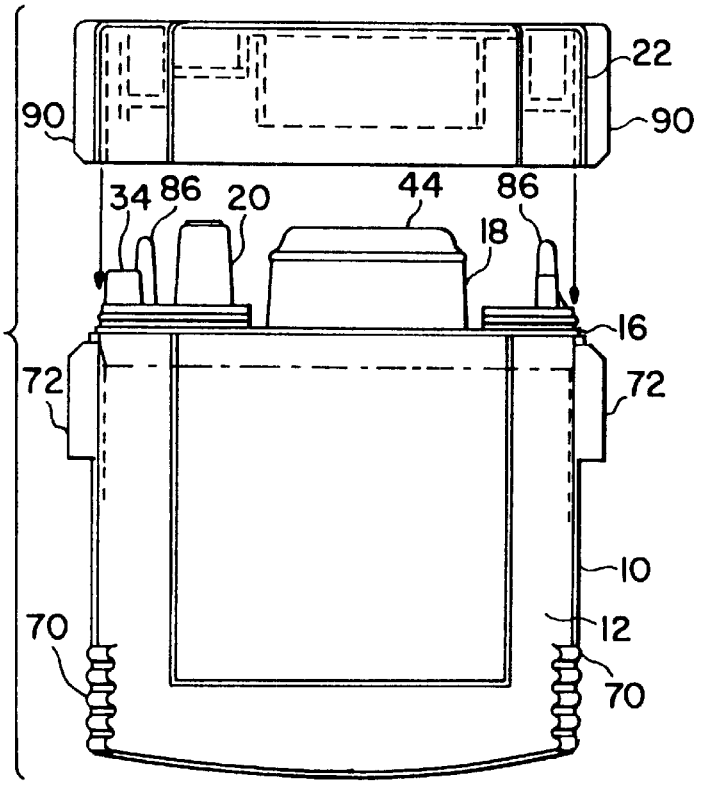
FIG. 2 is a an exploded view of the device of FIG. 1.
Figure 3:
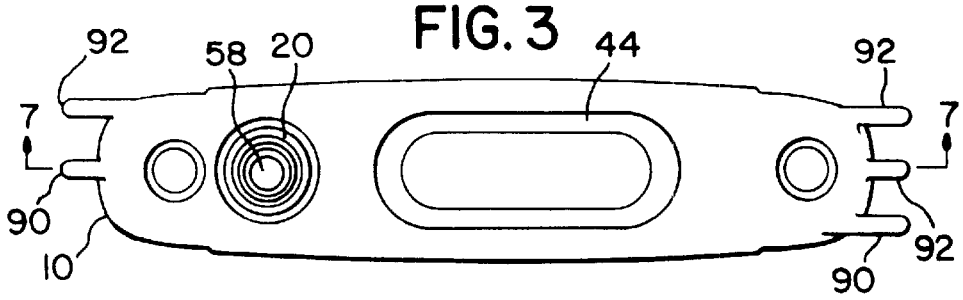
FIG. 3 is a plan view of the device of FIGS. 1 and 2 taken on line 3—3 of FIG. 1.
Figure 4:
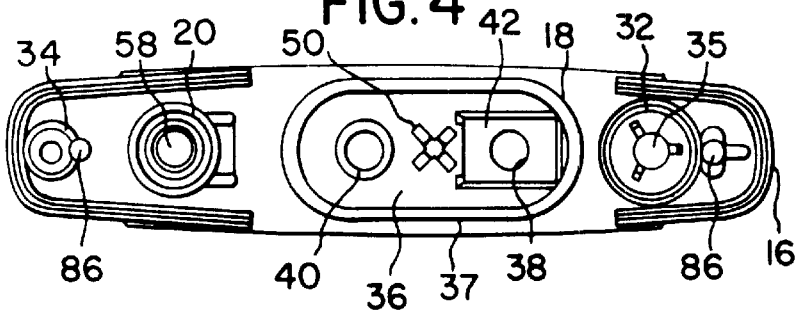
FIG. 4 is a plan view of a component of the device of FIGS. 1–3 taken on line 4—4 of FIG. 5.
Figure 5:
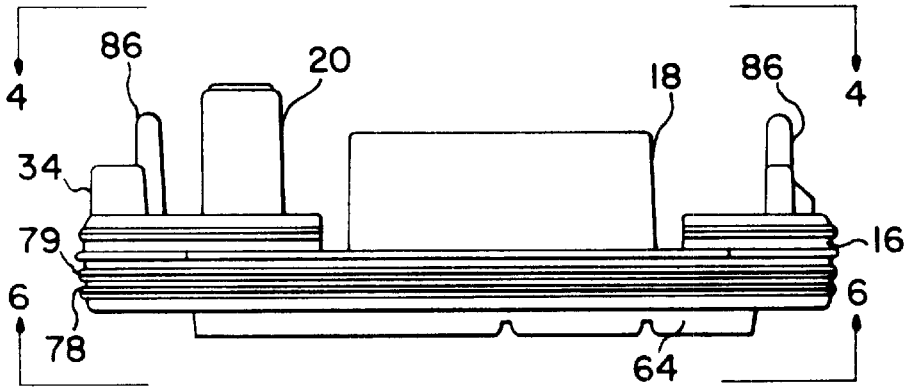
FIG. 5 is a side view of the component of FIG. 4.
Figure 6:
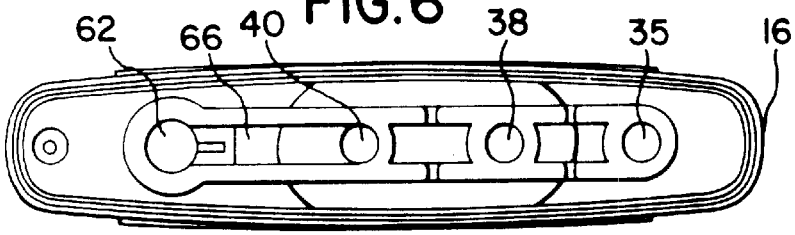
FIG. 6 is a plan view of the component of FIGS. 4 and 5 taken on line 6—6 of FIG. 5.
Figure 7:
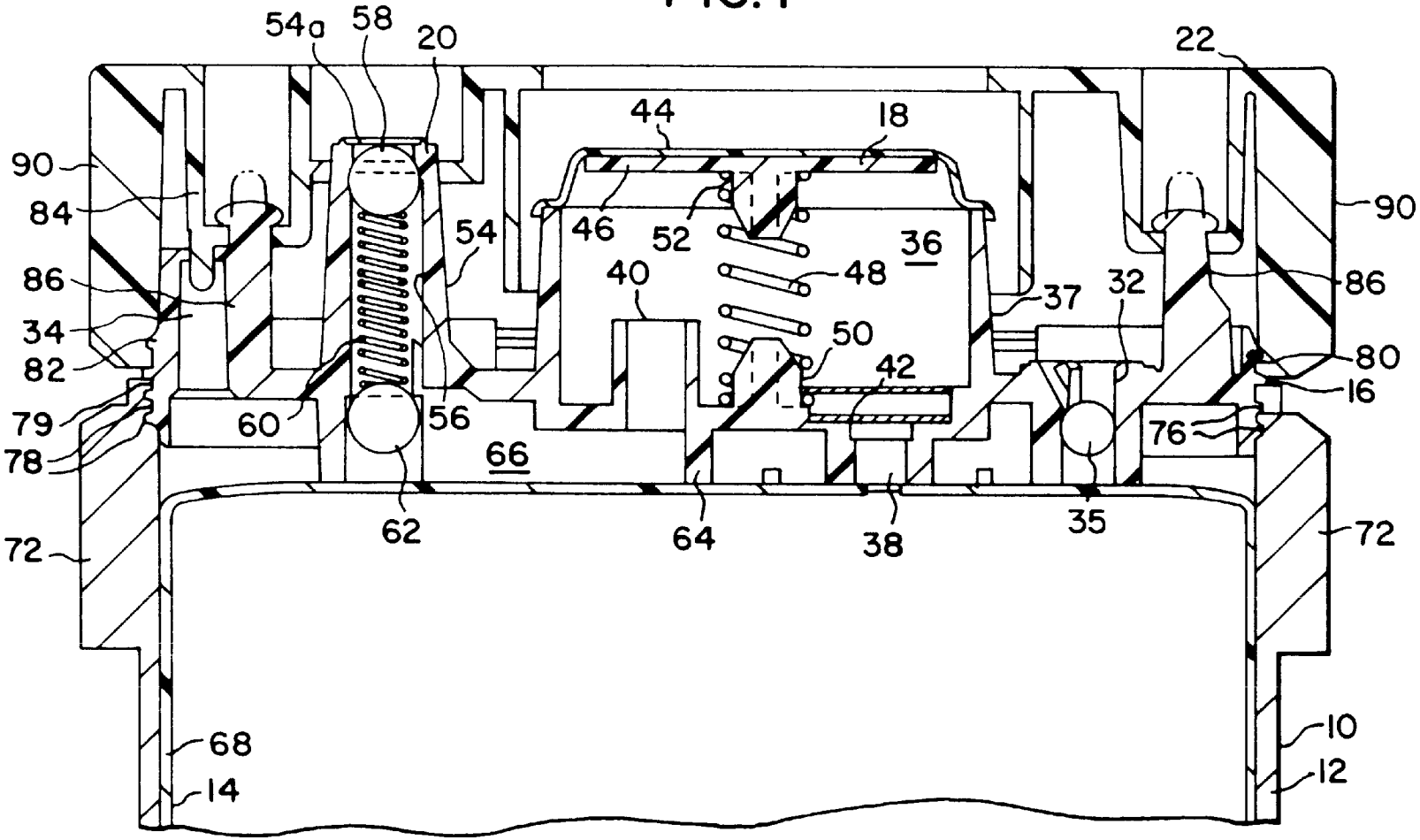
FIG. 7 is a fragmentary sectional view taken on line 7—7 of FIG. 3 and at an enlarged scale.
Figure 8:
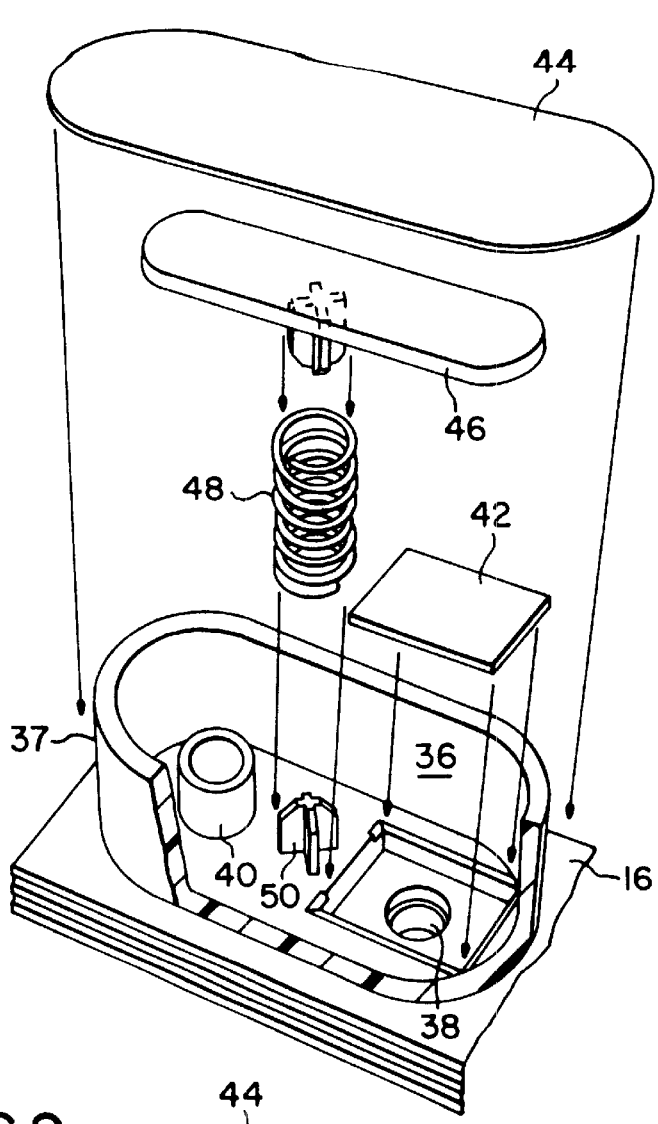
FIG. 8 is a fragmentary exploded view of a portion of the device of FIGS. 1–7.
Figure 9:
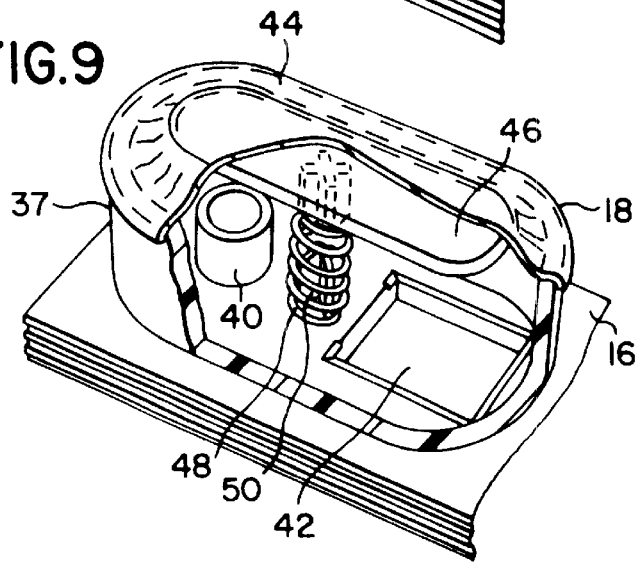
FIG. 9 is a fragmentary view similar to FIG. 8 showing the elements of FIG. 8 in assembled relationship to one another.

An ink containment and dispensing device in accordance with the embodiment of the invention described in the aforesaid U.S. patent application Ser. No. 08/429,987 is identified in FIG. 1 by reference numeral 10. The device 10 has a hard protective shell 12 which contains a flexible pouch 14 (FIG. 7) for containing ink. The shell 12 is attached to a chassis 16 (FIGS. 2 and 4–9), which houses a pump 18 and a fluid outlet 20. A protective cap 22 is attached to the chassis 16 and a label 24 is glued to the outside of the shell 12 and cap 22 elements of the device 10 to secure the shell 12, chassis 16, and cap 22 firmly together. The cap 22 is provided with apertures which allow access to the pump and the fluid outlet.

The device 10 is adapted to be removably inserted into a docking bay (not shown) within an ink-jet printer. When the device 10 is inserted into the printer, a fluid inlet in the docking bay is adapted to engage the fluid outlet 20 to allow ink flow from the device 10 to the printer. An actuator (not shown) in the docking bay is adapted to engage the pump 18. Operation of the actuator causes the pump 18 to provide ink in a series of small doses of a predetermined volume from the flexible pouch 14, through the fluid outlet 20, to the fluid inlet of the docking bay and then to the printer.

The chassis 16 is provided with a fill port 32 at one end and an exhaust port 34 at the other end. Ink can be added to the ink supply through the fill port 32 while air displaced by the added ink is exhausted through the exhaust port 34. After the ink supply is filled, the fill port 32 is sealed with a ball 35 press fit into the fill port 32.

A pumping chamber 36 having an open bottom is formed on the bottom of the chassis 16 within a rigid perimetrical wall 37, which is preferably formed integrally with the chassis 16. As described in more detail below, the chamber 36 can be pressured to supply ink to the printer without pressurizing the interior of the pouch 14. The top of the chamber 36 is provided with an inlet port 38 through which ink may enter the chamber 36 from the pouch 14 by gravity and/or by a negative pressure within the chamber 36. An outlet port 40 through which ink may be expelled from the chamber 36 is also provided.

A one-way flapper valve 42 located at the bottom of the inlet port 38 serves to limit the return of ink from the chamber 36 to the pouch 14. The flapper valve 42 is a rectangular piece of flexible material. In the illustrated embodiment the valve 42 is positioned over the bottom of the inlet port 38 and is heat staked to the chassis 16 at the midpoints of its short sides. When the pressure within the chamber 36 drops below that in the pouch 14, the unstaked sides of the valve 42 each flex to allow the flow of ink through the inlet port 38 and into the chamber 36. By heat staking the valve 42 to the chassis 16 along an opposed pair of sides, less flexing of the valve 42 is required or permitted than would be the case if the valve 42 were staked only along a single side, thereby ensuring that it closes more securely, and this effect is enhanced by doing the heat staking at the midpoints of the shorter sides, as opposed to the longer sides.

In the illustrated embodiment the flapper valve 42 is made of a two ply material. The outer ply is a layer of low density polyethylene 0.0015 inches thick. The inner ply is a layer of polyethylene terephthalate (PET) 0.0005 inches thick. The illustrated flapper valve 42 is approximately 5.5 millimeters wide and 8.7 millimeters long. Such a material is impervious to the flow of ink therethrough when the valve 42 is in its closed position.

The bottom of the chamber 36 is covered with a flexible diaphragm 44. The diaphragm 44 is slightly larger than the opening at the bottom of the chamber and is sealed around the free edge of the perimetrical wall 37 that defines the chamber 36. The excess material in the oversized diaphragm 44 allows the diaphragm to flex up and down to vary the volume of the chamber 36. In the illustrated device, the displacement of the diaphragm 44 allows the volume of the chamber 36 to be varied by about 0.7 cubic centimeters. The fully expanded volume of the illustrated chamber 36 is between about 2.2 and 2.5 cubic centimeters.

In the illustrated embodiment, the diaphragm 44 is made of a multi-ply material having a layer of low density polyethylene 0.0005 inches thick, a layer of adhesive, a layer of metallized polyethylene terephthalate (PET) 0.00048 inches thick, a layer of adhesive, and a layer of low density polyethylene 0.0005 inches thick. Of course, other suitable materials may also be used to form the diaphragm 44. The diaphragm 44 in the illustrated embodiment is heat staked, using conventional methods, to the free edge of the wall 37 of the chamber 36. During the heat staking process, the low density polyethylene in the diaphragm will seal any folds or wrinkles in the diaphragm 44. The diaphragm 44, thus, is impervious to the transmission of oxygen and moisture therethrough, thereby safeguarding the ink in the chamber 36 from degradation by exposure to any such substance.

Within the chamber 36 a pressure plate 46 is positioned adjacent the diaphragm 44, the pressure plate 46 serving as a piston with respect to the chamber 36. A pump spring 48, made of stainless steel in the illustrated embodiment, biases the pressure plate 46 against the diaphragm 44 to urge the diaphragm outward so as to expand the size of the chamber 36. One end of the pump spring 48 is received on a spike 50 formed on the top of the chamber 36 and the other end of the pump spring 48 is received on a spike 52 formed on the pressure plate 46 in order to retain the pump spring 48 in position. The pressure plate 46 in the illustrated embodiment is molded of high density polyethylene.

A hollow cylindrical boss 54 extends downward from the chassis 16 to form the housing of the fluid outlet 20, the boss 54 being formed integrally with the chassis 16. A bore 56 of the hollow boss 54 has a narrow throat 54*a* at its lower end. A sealing ball 58, made of stainless steel in the illustrated embodiment, is positioned within the bore 56. The sealing ball 58 is sized such that it can move freely within the bore 56, but cannot pass through the narrow throat portion 54*a* thereof. A sealing spring 60 is positioned within the bore 56 to urge the sealing ball 58 against the narrow throat 54*a* to form a seal and prevent the flow of ink through the fluid outlet. A retaining ball 62, made of stainless steel in the illustrated embodiment, is press fit into the top of the bore to retain the sealing spring 60 in place. The bore 56 is configured to allow the free flow of ink past the retaining ball 62 and into the bore 56.

A raised manifold 64 is formed on the top of the chassis 16. The manifold 64 forms a cylindrical boss around the top of the fill port 32 and a similar boss around the top of the inlet port 38 so that each of these ports is isolated. The manifold 64 extends around the base of the fluid outlet 20 and the outlet port 40 to form an open-topped conduit 66 joining the two outlets.

The flexible ink pouch 14 is attached to the top of the manifold 64 so as to form a top cover for the conduit 66. In the illustrated embodiment, this is accomplished by heat staking a rectangular plastic sheet 68 to the top surface of the manifold 64 to enclose the conduit 66. In the illustrated embodiment, the chassis 16 molded of high density polyethylene and the plastic sheet is low density polyethylene that is 0.002 inches thick. These two materials can be easily heat staked to one another using conventional methods and are also readily recyclable.

After the plastic sheet 68 is attached to the chassis 16, the sheet is folded and sealed around its two sides and top to form the flexible ink pouch 14. Again, in the illustrated embodiment, heat staking can be used to seal the perimeter of the flexible pouch 14. The plastic sheet over the fill port 32 and over the inlet port 38 can be punctured, pierced, or otherwise removed so as not to block the flow of ink through these ports.

Although the flexible pouch 14 provides an ideal way to contain ink, it may be easily punctured or ruptured and allows a relatively high amount of water loss from the ink. Accordingly, to protect the pouch 14 and to limit water loss, the pouch 14 is enclosed within the protective shell 12. In the illustrated embodiment, the shell 12 is made of clarified polypropylene, which is sufficiently translucent to permit inspection of the ink within the pouch 14 to determine that an adequate volume of ink remains for proper operation of the printer. A thickness of about one millimeter has been found to provide robust protection and to prevent unacceptable water loss from the ink. However, the material and thickness of the shell may vary in other embodiments.

The top of the shell 12 has a number of raised ribs 70 to facilitate gripping of the shell 12 as it is inserted in or withdrawn from the docking bay. A vertical rib 72 projects laterally from each side of the shell 12. The vertical rib 72 can be received within a slot (not shown) in the docking bay to provide lateral support and stability to the ink supply when it is positioned within the printer. The bottom of the shell 12 is provided with two circumferential grooves or recesses 76 which engage two circumferential ribs or beads 78 formed on a depending perimetrical wall 79 of the chassis 16 to attach the shell 12 to the chassis 16 in a snap fit.

The attachment between the shell 12 and the chassis 16 should, preferably, be snug enough to prevent accidental separation of the chassis from the shell and to resist the flow of ink from the shell should the flexible reservoir develop a leak. However, it is also desirable that the attachment not form a hermetic seal to allow the slow ingress of air into the shell as ink is depleted from the reservoir 14 to maintain the pressure inside the shell generally the same as the ambient pressure. Otherwise, a negative pressure may develop inside the shell and inhibit the flow of ink from the reservoir. The ingress of air should be limited, however, in order to maintain a high humidity within the shell and minimize water loss from the ink.

In the illustrated embodiment, the shell 12 and the flexible pouch 14 which it contains have the capacity to hold approximately thirty cubic centimeters of ink. The shell is approximately 67 millimeters wide, 15 millimeters thick, and 60 millimeters high. The flexible. pouch 14 is sized so as to fill the shell without undue excess material. Of course, other dimensions and shapes can also be used depending on the particular needs of a given printer.

To fill the device 10, ink can be injected through the fill port 32. As it is filled, the flexible pouch 14 expands so as to substantially fill the shell 12. As ink is being introduced into the pouch, the sealing ball 58 can be depressed to open the fluid outlet and a partial vacuum can be applied to the fluid outlet 20. The partial vacuum at the fluid outlet causes ink from the pouch 14 to fill the chamber 36, the conduit 66, and the bore 56 of the cylindrical boss 54 such that little, if any, air remains in contact with the ink. The partial vacuum applied to the fluid outlet 20 also speeds the filling process. To further facilitate the rapid filling of the pouch, an exhaust port 34 is provided to allow the escape of air from the shell as the reservoir expands. Once the ink supply is filled, a ball 35 is press fit into the fill port 32 to prevent the escape of ink or the entry of air.

Of course, there are a variety of other ways which can also be used to fill the present ink containment and dispensing device. In some instances, it may be desirable to flush the entire device with carbon dioxide prior to filling it with ink. In this way, any gas trapped within the device during the filling process will be carbon dioxide, not air. This may be preferable because carbon dioxide may dissolve in some inks while air may not. In general, it is preferable to remove as much gas from the device as possible so that bubbles and the like do not enter the print head or the trailing tube.

The protective cap 22 is placed on the device 10 after the reservoir is filled. The protective cap is provided with a groove 80 which receives a rib 82 on the chassis to attach the cap to the chassis. The cap carries a lug 84 which plugs the exhaust port 34 to limit the flow of air into the chassis-and reduce water loss from the ink. A stud 86 extends from each end of the chassis 16 and is received within an aperture in the cap 22 to aid in aligning the cap and to strengthen the union between the cap and the chassis. The free ends of the studs 86, which extend beyond the apertures of the cap 22, are preferably deformed after the cap 22 is in place, for example, by contacting them with a heated tool, to provide a tamper resistant attachment of the cap 22 to the chassis 16. Further, the label 24 is glued to the sides of the device 10 to hold the shell 12, chassis 16, and cap 22 firmly together. In the illustrated embodiment, a hot-melt pressure sensitive or other adhesive is used to adhere the label in a manner that prevents the label from being peeled off and inhibits tampering with the ink supply.

The cap 22 in the illustrated embodiment is provided with a vertical rib 90 protruding from each side. The rib 90 is an extension of the vertical rib 72 on the shell and is received within the slot provided in the docking bay in a manner similar to the vertical rib 72. In addition to the rib 90, the cap 22 has protruding keys 92 located on each side of the rib 90. One or more of the keys 92 can be optionally deleted or altered so as to provide a unique identification of the particular ink supply by color or type. Mating keys (not shown), identifying a particular type or color of ink supply can be formed in the docking bay. In this manner, a user cannot inadvertently insert an ink supply of the wrong type or color into a docking bay. This arrangement is particularly advantageous for a multi-color printer where there are adjacent docking bays for ink supplies of various colors.

In developing an ink supply according to that of FIGS. 1–9, it was found to be useful to circumscribe the flexible ink pouch 14 within a perimetrical frame to protect it from impact and shock loads, and to facilitate the assembly of the chassis 16, to which the flexible ink pouch 14 was attached, into the shell 12. Unfortunately, such a perimetrical frame tends to reduce the volume of ink that can be contained within the pouch 14 if the design of the protective shell 12 is not modified to accommodate a protective perimetrical frame without reducing the volume within the protective shell that is available to surround an ink-containing pouch 14. This requirement can be met in various ways, as illustrated in the embodiments of the invention depicted in FIGS. 10, 14 and 18; FIGS. 11, 15 and 19; and FIGS. 13, 16 and 21, respectively.

Figure 10:
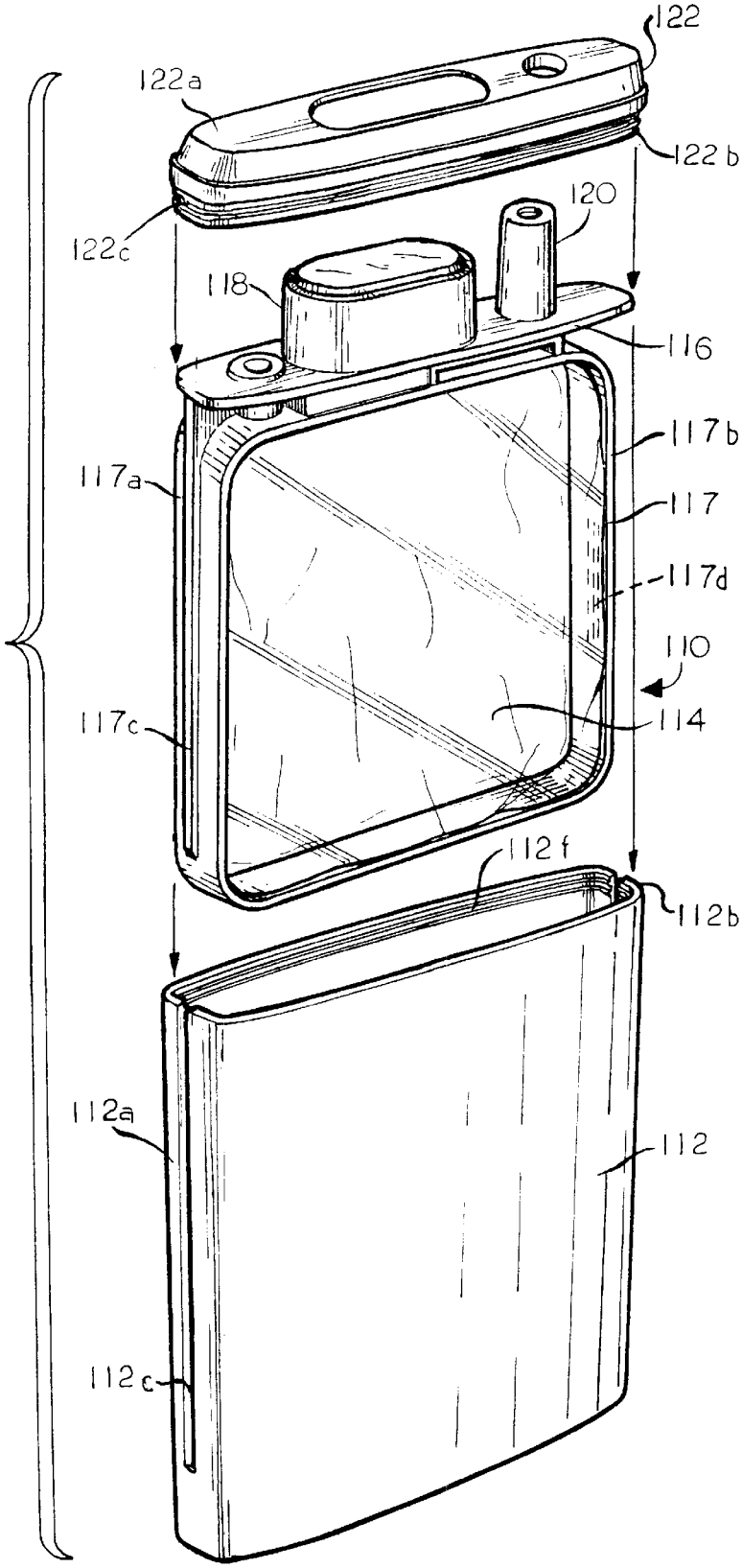
FIG. 10 is an exploded, perspective view of an alternative embodiment of an ink supply according to the present invention.
Figure 11:
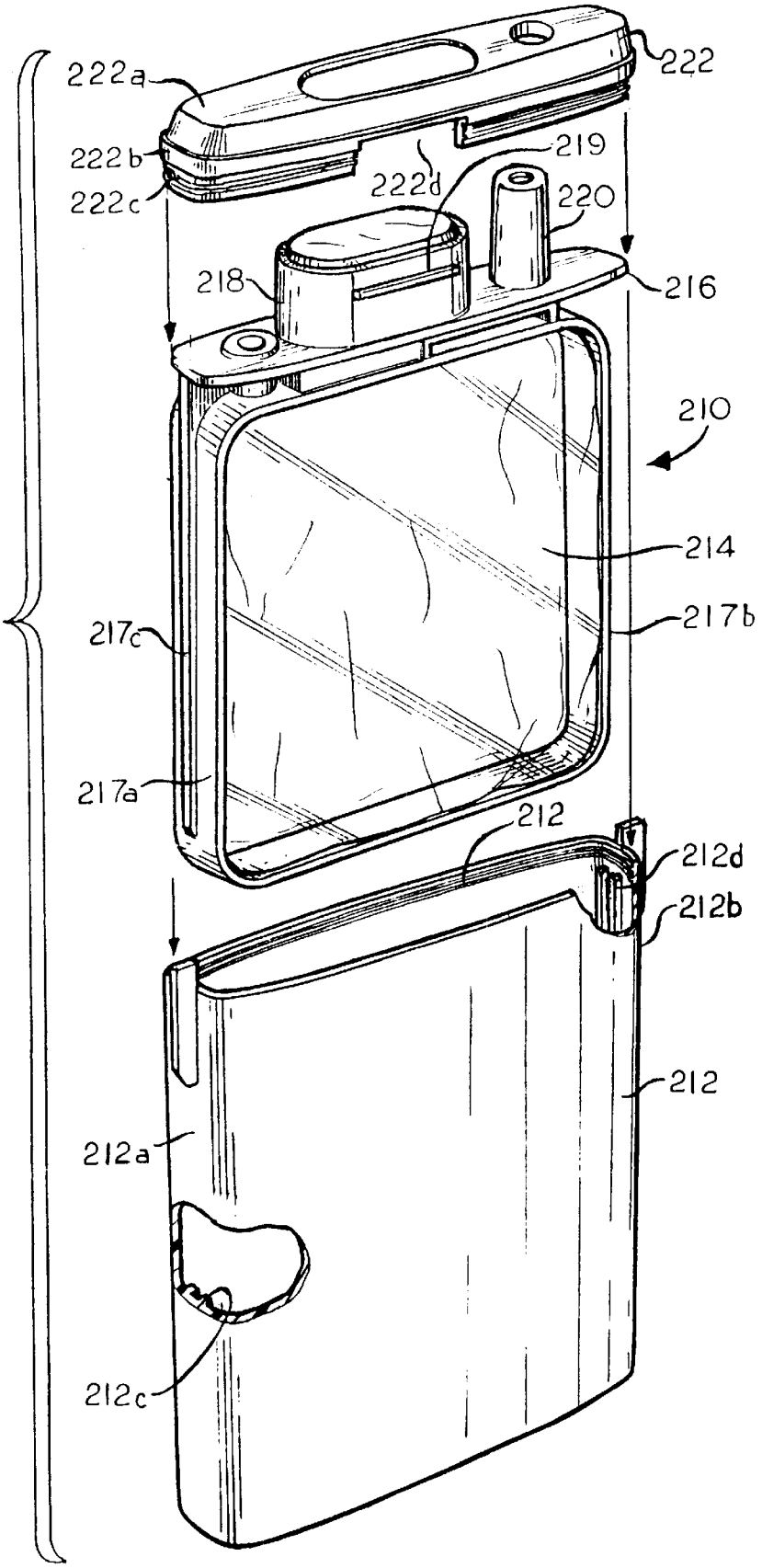
FIG. 11 is a view similar to FIG. 10 of another alternative embodiment of the present invention.
Figure 14:
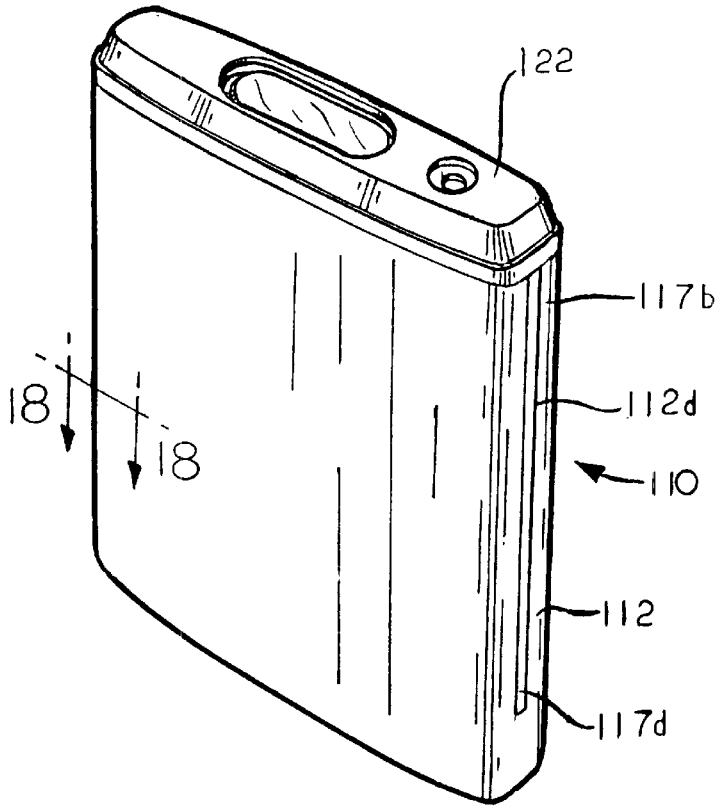
FIG. 14 is a perspective view of the ink supply of FIG. 10.
Figure 18:
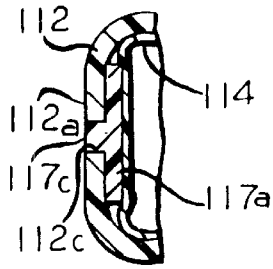
FIG. 18 is a sectional view taken on line 18—18 of FIG. 14.
Figure 19:
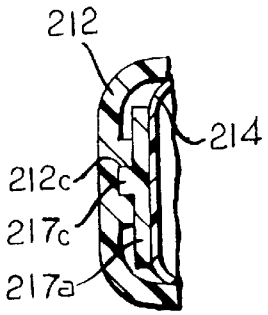
FIG. 19 is a sectional view taken on line 19—19 of FIG. 15.
Figure 15:
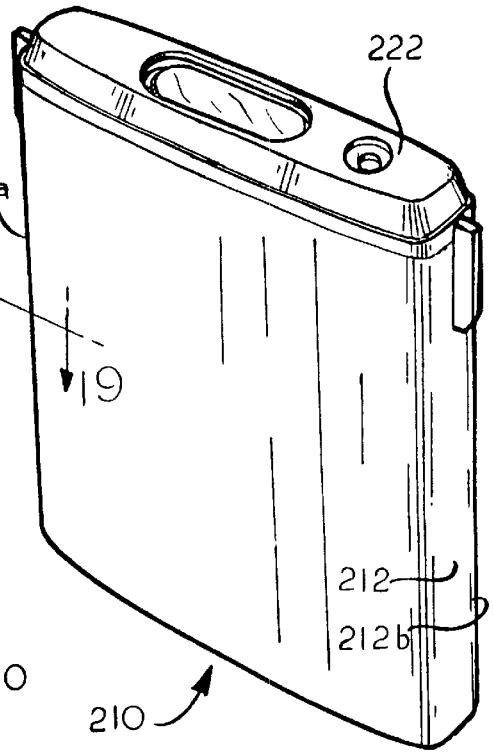
FIG. 15 is a view similar to FIG. 14 of the ink supply of FIG. 11.

In the embodiment of the invention illustrated in FIGS. 10, 14 and 18, elements corresponding to the elements of the embodiment of FIGS. 1–9 are identified by a 100 series numeral, the last two digits of which are the two digits of the corresponding element of the invention of FIGS. 1–9.

The ink containment and dispensing device of FIGS. 10, 14 and 18 is generally identified by reference numeral 110 and, except as hereinafter described, corresponds to the device 10 of FIGS. 1–9. The device 110 has a hard protective shell 112 which is open at one end and contains a flexible pouch 114 for containing ink. The shell 112 and an open end of the pouch 114 are attached to a chassis 116, which houses a pump 118 and a fluid outlet 120. A protective cap 122 is attached to the chassis 116. The opposed end of the pouch 114 is closed.

The device 110 is adapted to be removably inserted into a docking bay (not shown) within an ink-jet printer in the same manner as the device 10 of the embodiment of FIGS. 1–9. When the device 110 is inserted into the printer, a fluid inlet in the docking bay is adapted to engage the fluid outlet 120 to allow ink flow from the device 110 to the printer, similar to the arrangement of the device of the embodiment of FIGS. 1–9. An actuator (not shown) in the docking bay is adapted to engage the pump 118. Operation of the actuator causes the pump 118 to provide ink in a series of small doses of a predetermined volume from the flexible pouch 114, through the fluid outlet 120, to the fluid inlet of the docking bay and then to the printer.

To protect the flexible pouch 114 from impact and shock loads, and to facilitate the insertion of the chassis 116 into the shell 112, the shell 112 is provided with an annular frame 117 formed integrally therewith in a single piece, as by injection molding from a suitable thermoplastic material. The annular frame 117, which extends transversely from a planar portion of the chassis that extends transversely of the open end of the shell 112, has a spaced-apart pair of short side members 117*a*, 117*b*, and surrounds the flexible pouch 114. For added rigidity each of the side members 117*a*, 117*b* has a rib 117*c*, 117*d*, respectively, projecting perpendicularly outwardly therefrom.

The shell 112 is generally rectangularly shaped, with a spaced-apart pair of shorter sides 112*a*, 112*b* that are disposed adjacent the side members 117*a*, 117*b*, respectively, of the annular frame 117. To accommodate the projection of the ribs 117*c*, 117*d* of the side members 117*a*, 117*b*, respectively, of the perimetrical frame 117, the shorter sides 112*a*, 112*b* of the shell 112 are provided with elongate slots 112*c*, 112*d*, respectively, and the ribs 117*c*, 117*d* project into the slots 112*c*, 112*d*, respectively, as is clearly illustrated in FIG. 18. This arrangement between the ribs 117*c*, 117*d* and the slots 112*c*, 112*d* increases the spacing between the side members 117*a*, 117*b* for a given width of the shell 112, and thereby increases the volume of ink that can be contained within the flexible pouch 114.

To increase the resistance of the device 110 to inadvertent disengagement of any of the shell 112, chassis 116 or cap 122 from one another due to shock or impact loads, the chassis 116 is contained entirely within the shell 112, and the cap 122, which has a top panel portion 122*a* with a perimetrical depending flange 122*b*, is secured to the shell 112 by telescopically inserting the flange 122*b* into the upper open end of the shell 122. The engagement of the cap 122 to the shell 112 is positively restrained by providing the exterior of the flange 122*b* with an outwardly projecting rib 122*c*, and by providing the interior of the upper open end of the shell 112 with an inwardly projecting recess 112*f* into which the rib 122*c* is received in an interference fit. Further, the cap 122 can then be even more positively secured to the shell 112 by heat sealing or sonically welding the cap 122 and the shell 112 to one another.

In the embodiment of the invention illustrated in FIGS. 11, 15 and 19, elements corresponding to the elements of the embodiment of FIGS. 10, 14 and 18 are identified by a 200 series numeral, the last two digits of which are the last two digits of the embodiment of FIGS. 10, 14 and 18.

The ink containment and dispensing device of FIGS. 11, 15 and 19 is generally identified by reference numeral 210 and, except as hereinafter described, corresponds to the device 110 of the embodiment of FIGS. 10, 14 and 18. The device 210 has a hard protective shell 212 which is open at one end and contains a flexible pouch 214 for containing ink. The shell 212 and an open end of the pouch 214 are attached to a chassis 216, which houses a pump 218 and a fluid outlet 220. A protective cap 222 is attached to the chassis 216. The device 210 is adapted to be removably inserted into a docking bay (not shown) within an ink-jet printer. When the device 210 is inserted into the printer, a fluid inlet in the docking bay is adapted to engage the fluid outlet 220 to allow ink flow from the device 216 to the printer. An actuator (not shown) in the docking bay is adapted to engage the pump 218. Operation of the actuator causes the pump 218 to provide ink in a series of small doses of a predetermined volume from the flexible pouch 214, through the fluid outlet 220, to the fluid inlet of the docking bay and then to the printer.

To protect the flexible pouch 214 from impact and shock loads, and to facilitate the insertion of the chassis 216 into the shell 212, the chassis 216 is provided with a depending annular frame 217 formed integrally therewith and in a single piece, as by injection molding from a suitable thermoplastic material. The annular frame 217, which extends transversely from a planar portion that extends transversely of the open end of the shell 212, has a spaced-apart pair of short side members 217*a,* 217*b,* and surrounds the flexible pouch 214. For added rigidity each of the side members 217*a,* 217*b* has a rib 217*c,* 217*d,* respectively, projecting perpendicularly outwardly therefrom.

The shell 212 is generally rectangularly shaped, with a spaced-apart pair of shorter sides 212*a,* 212*b* that are disposed adjacent the side members 217*a,* 217*b,* respectively, of the perimetrical frame 217. To adequately restrain the side members 217*a,* 217*b,* with respect to the shell 212 during the insertion of the frame 217 of a chassis 216 into the shell 212 and thereafter, the sides 212*a,* 212*b* of the shell 212 are provided with inwardly facing recesses 212*c,* 212*d,* respectively. The interaction between the ribs 217*c,* 217*d,* and the recesses 212*c,* 212*d,* respectively, thus, facilitates the insertion of the chassis 216, with the perimetrical frame 217, into the shell 212, and the retention of the chassis 216 and the frame 217 in the shell 212, notwithstanding shock or impact loads encountered by the device 210 during shipping, handling or service.

To increase the resistance of the device 210 to inadvertent disengagement of any of the shell 212, chassis 216 or cap 222 from one another due to shock or impact loads, the chassis 216 is contained entirely within the shell 212, and the cap 222, which has a top panel portion 222*a* with a perimetrical depending flange 222*b,* is secured to the shell 212 by telescopically inserting the flange 222*b* into the upper open end of the shell 212. The engagement of the cap 222 to the shell 212 is positively restrained by providing the exterior of the flange 222*b* with an outwardly projecting rib 222*c,* and by providing the interior of the upper open end of the shell 212 with an inwardly projecting recess 212*f* into which the rib 222*c* is received in an interference fit. Further, the cap 222 can then be even more positively secured to the shell 212 by heat sealing or sonically welding the cap 222 and the shell 212 to one another.

To positively axially position the cap 222 and the chassis 216 with respect to one another, the sides of the pump 218 of the chassis 216 are provided with opposed outwardly projecting ribs 219 (only one such rib shown in FIG. 11) and the flange 222*b* of the cap 222 is provided with slots 222*d* (only one such slot shown in FIG. 11) along its opposed longer sides. The ribs 219 are received in the slots 222*d* when the cap 222 and the chassis 216 are assembled together, with the ribs 219 engaging the interior ends of the slots 222*c* to properly axially position the cap 222 and the chassis 216 with respect to one another.

Figure 12:
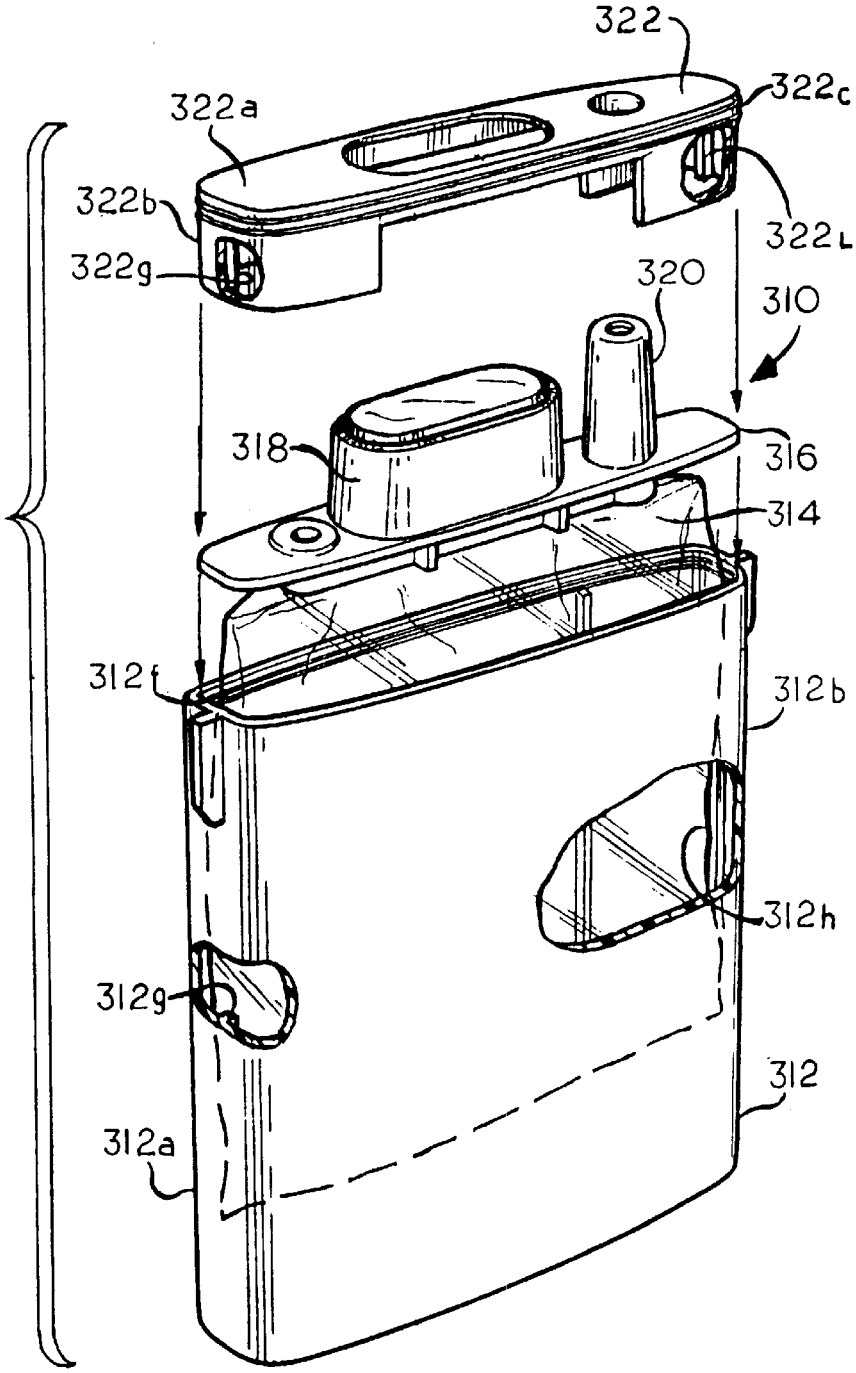
FIG. 12 is a view similar to FIGS. 10 and 11 of another alternative embodiment of the present invention.
Figure 20:
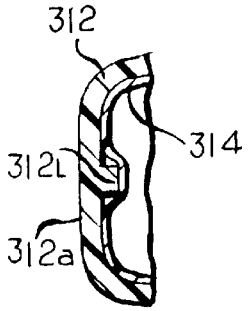
FIG. 20 is a sectional view taken on line 20—20 of FIG. 16.
Figure 16:
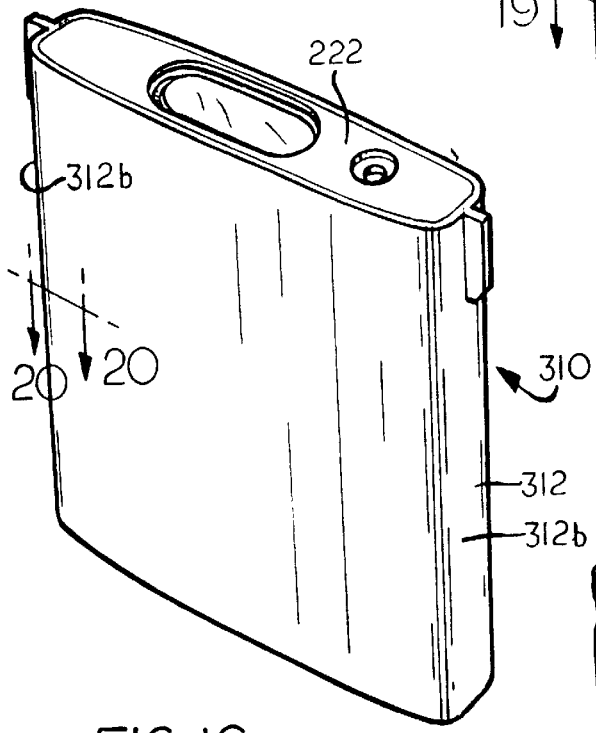
FIG. 16 is a view similar to FIGS. 14 and 15 of the ink supply of FIG. 12.

In the embodiment of the invention illustrated in FIGS. 12, 16 and 20, elements corresponding to the elements of the embodiment of FIGS. 10, 14 and 18 are identified by a 300 series numeral, the last two digits of which are the last two digits of the embodiment of FIGS. 10, 14 and 18.

The ink containment and dispensing device of FIGS. 12, 16 and 20 is generally identified by reference numeral 310 and, except as hereinafter described, corresponds to the device 110 of the embodiment of FIGS. 10, 14 and 18. The device 310 has a hard protective shell 312 which is open at one end and contains a flexible pouch 314 for containing ink. An open end of pouch 314 is attached to a chassis 316, which houses a pump 318 and a fluid outlet 320. A protective cap 322 is attached to the chassis 316.

The device 310 is adapted to be removably inserted into a docking bay (not shown) within an ink-jet printer. When the device 310 is inserted into the printer, a fluid inlet in the docking bay is adapted to engage the fluid outlet 320 to allow ink flow from the device 310 to the printer. An actuator (not shown) in the docking bay is adapted to engage the pump 318. Operation of the actuator causes the pump 318 to provide ink in a series of small doses of a predetermined volume from the flexible pouch 314, through the fluid outlet 320, to the fluid inlet of the docking bay and then to the printer.

To increase the resistance of the device 310 to inadvertent disengagement of any of the shell 312, chassis 316 or cap 322 from one another due to shock or impact loads, the chassis 316 is contained entirely within the shell 312, and the cap 322, which has a top panel portion 322*a* with a perimetrical depending flange 322*b,* is secured to the shell 312 by telescopically inserting the flange 322*b* of the cap 322 into the upper open end of the shell 312. The engagement of the cap 322 to the shell 312 is positively restrained by providing the exterior of the flange 322*b* with an outwardly projecting rib 322*c,* and by providing the interior of the upper open end of the shell 312 with an inwardly projecting recess 312*f* into which the rib 322*c* is received in an interference fit. Further, the cap 322 can then be even more positively secured to the shell 312 by heat sealing or sonically welding the cap 322 and the shell 312 to one another.

The engagement of the chassis 316 to the shell 312 is positively restrained by molding the chassis 316 with a thin, planar member 316*a* and by providing the shell 312, and preferably its opposed, short side members 312*a,* 312*b,* with interior, longitudinally extending ribs 312*g,* 312*h,* respectively, that extend partly to the open end of the shell 312. The tops of the ribs 312*g,* 312*h,* then, form stops against which the bottom of the planar member 316*a* of the chassis 316 is restrained by the telescopic engagement of the chassis 316 into the open end of the shell 312. In that regard, the flange 322*b* of the cap 322 is provided with ribs 322*h,* 322*g,* on opposed ends of its inside surface. The ribs 322*h,* 322*g* extend partly to the open end of the cap 322 to engage the top of the planar member 316*a* of the chassis 316, and preferably in alignment with the ribs 312*g,* 312*h,* respectively, of the shell 312.

As illustrated in FIGS. 12 and 16, the top panel portion 322*a* of the cap 322 is planar and fits entirely within the open end of the shell 312, unlike the top panel portion 222*a* of the cap 222 of the embodiment of FIGS. 11 and 15 and the top panel portion 122*a* of the cap 122 of the embodiment of FIGS. 10 and 14, which are domed upwardly and extend beyond the open ends of the shells 212, 112, respectively.

Figure 13:
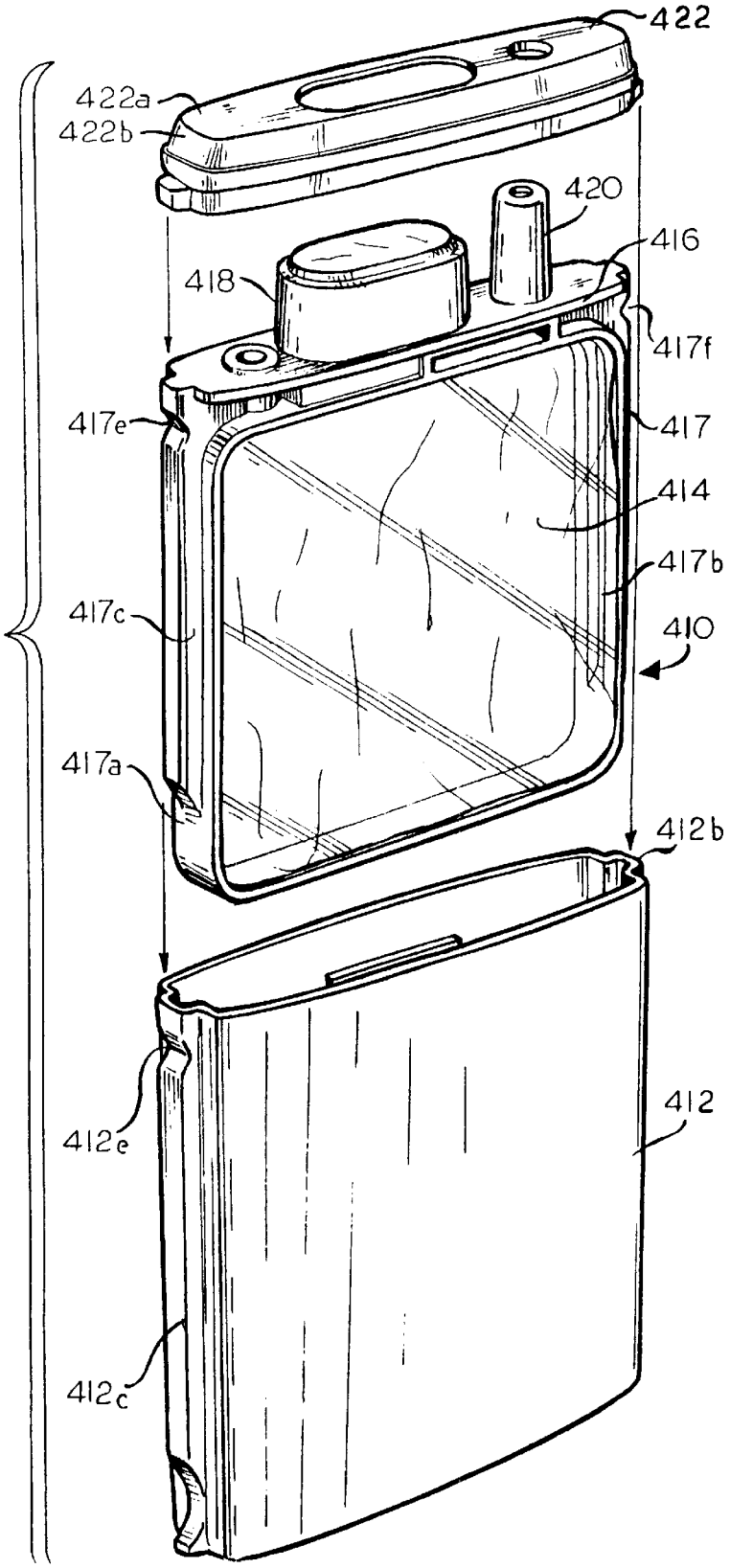
FIG. 13 is a view similar to FIGS. 10, 11 and 12 of another alternative embodiment of the present invention.
Figure 21:
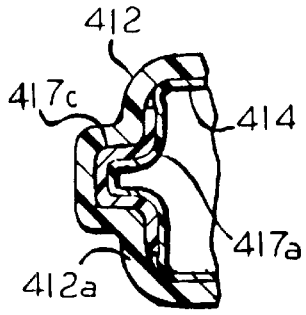
FIG. 21 is a sectional view taken on line 21—21 of FIG. 17.
Figure 17:
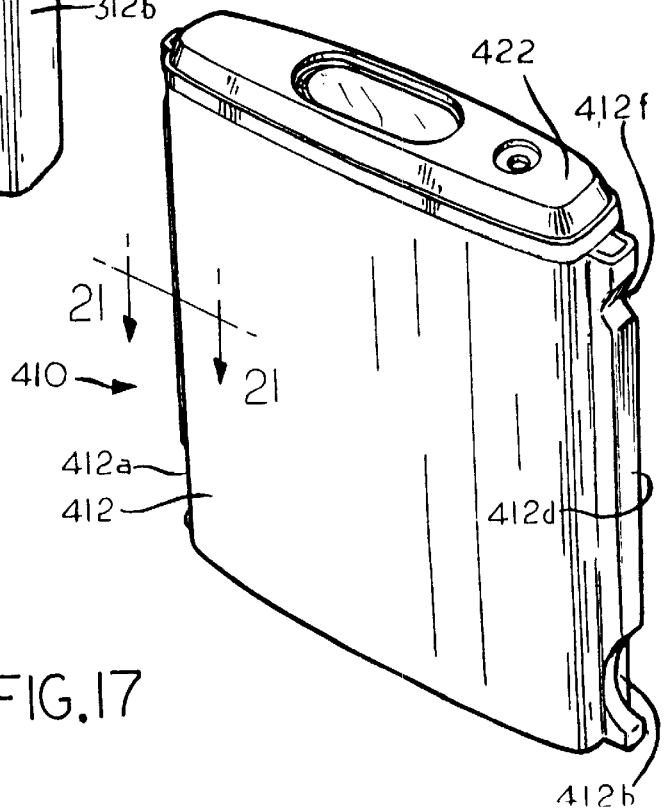
FIG. 17 is a view similar to FIGS. 14, 15 and 16 of the ink supply of FIG. 13.

In the embodiment of the invention illustrated in FIGS. 13, 17 and 21, elements corresponding to the elements of the embodiment of FIGS. 10, 14 and 18 are identified by a 400 series numeral, the last two digits of which are the last two digits of the embodiment of FIGS. 10, 14 and 18.

The ink containment and dispensing device of FIGS. 13, 17 and 21 is generally identified by reference numeral 410 and, except as hereinafter described, corresponds to the device 110 of the embodiment of FIGS. 10, 14 and 18. The device 410 has a hard protective shell 412 which is open at one end and contains a flexible pouch 414 for containing ink. The shell 412 is attached to a chassis 416, which houses a pump 418 and a fluid outlet 420. A protective cap 422 is attached to the chassis 416.

The device 410 is adapted to be removably inserted into a docking bay (not shown) within an ink-jet printer. When the device 410 is inserted into the printer, a fluid inlet in the docking bay is adapted to engage the fluid outlet 420 to allow ink flow from the device 410 to the printer. An actuator (not shown) in the docking bay is adapted to engage the pump 418. Operation of the actuator causes the pump 418 to provide ink in a series of small doses of a predetermined volume from the flexible pouch 414, through the fluid outlet 420, to the fluid inlet of the docking bay and then to the printer.

To increase the resistance of the device 410 to inadvertent disengagement of any of the shell 412, chassis 416 or cap 422 from one another due to shock or impact loads, the chassis 416 is contained entirely within the shell 412, and the cap 422, which has a top panel portion 422*a* with a perimetrical depending flange 422*b*, is secured to the shell 412 by telescopically inserting the flange 422*b* into the upper open end of the shell 422.

To protect the flexible pouch 414 from impact and shock loads, the chassis 416 is provided with an annular frame 417 formed integrally therewith in a single piece, as by injection molding from a suitable plastic material. The annular frame 417, which extends transversely from a planar portion of the chassis for 416 that extends transversely of the open end of the shell 412, has a spaced-apart short side members 417*a*, 417*b*, surrounds the flexible pouch 414. For added rigidity each of the side members 417*a*, 417*b* has a hollow rib 417*c*, 417*d*, projecting perpendicularly outwardly therefrom. In that regard, the flexible pouch 414 extends partly into the hollow ribs 417*c*, 417*d*, as is shown in connection with the hollow rib 417*c* in FIG. 21, to maximize the internal volume of the flexible pouch 414.

The shell 412 is generally rectangularly shaped, with a spaced-apart pair of shorter sides 412*a*, 412*b* that are disposed adjacent the side members 417*a*, 417*b*, respectively, of the perimetrical frame 417. To adequately restrain the side members 417*a*, 417*b*, with respect to the shell 412, the sides 412*a*, 412*b* of the shell 412 are provided with outwardly facing hollow recesses 412*c*, 412*d*, respectively. The interaction between the hollow ribs 417*c*, 417*d* and the recesses 412*c*, 412*d*, respectively, thus, facilitates the insertion of the chassis 416, with the perimetrical frame 417, into the shell 412 and the retention of the chassis 416 and the frame 417 in the shell 412, notwithstanding shock or impact loads encountered by the device 410 during shipping, handling or service. Further, to assist in the proper axial orientation of the chassis 416, with the perimetrical frame 417, with respect to the shell 412, the hollow ribs 417*c*, 417*d* of the perimetrical frame 417 are provided with inwardly projecting notches 417*e*, 417*f*, respectively, and the hollow recesses 412*c*, 412*d* of the short sides 412*a*, 412*b*, respectively, of the shell 412 are provided with inwardly projecting ribs 412*e*, 412*f* that are received in the notches 412*e*, 412*f*, of the shell 412, respectively.

The liquid containment and dispensing device of the various embodiments of the present invention has been specifically described as a device for containing and dispensing a supply of printing ink in an ink jet printer as the preferred embodiment of the invention. However, it is also contemplated that the present invention can easily be adapted to the containment and dispensing of other Newtonian (low viscosity) liquids.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims and the legal equivalents thereof.

What is claimed:

1. A liquid containment and dispensing device having a rigid, generally cup-shaped outer shell with an open end and an opposed pair of sidewalls, each of the opposed pair of sidewalls having a longitudinally extending recess therein, a chassis secured to the open end of the shell, the chassis having a pumping mechanism with a liquid outlet therefrom the chassis further having a planar portion extending transversely of the open end of the shell, a flexible pouch having an open end and a closed end, the closed end being positioned within the shell, the chassis further having an annular frame extending transversely from the planar portion, the frame surrounding the flexible pouch and having an opposed pair of side members with a rib portion extending outwardly from each of said side members, characterized in that each of said opposed pair of side members is adjacent one of the side walls of the outer shell, the rib portion of each of said opposed pair of side members extending into one of the recesses in the sidewall of the shell.

2. A liquid containment and dispensing device according to claim 1 wherein the recess of each of the sidewalls of the shell is an opening extending through said each of the sidewalls of the shell.

3. A liquid containment an dispensing device according to claim 1 wherein the recess in each of the sidewalls of the shell is an outwardly projecting, generally U-shaped recess.

4. A liquid containment and dispensing device according to claim 1;

the cap is heat sealed to the shell.

5. The method of imparting shock load resistance to a liquid containment and dispensing device comprising a cup-shaped outer shell with a sidewall and an open end, a flexible pouch with an open end and a closed end, the closed end being positioned within the shell, and a chassis telescopically received within the shell and having a generally perimetrical frame with an opposed pair of side members depending therefrom and surrounding the flexible pouch, said method comprising:

providing an opposed pair of recesses in the sidewall of the shell;

providing each of the opposed pair of side members with an externally projecting rib portion; and inserting the chassis within the shell with the externally projecting rib portion of each of the side members snugly within the opposed pair of recesses of the outer shell.

6. The method of securing a cap to an open end of a generally cup-shaped shell of a liquid containment and dispensing device, the liquid containment and dispensing device having a chassis accurately positioned within the open end of the shell, the cap overlying the chassis and having a depending perimetrical skirt, said method comprising:

providing the perimetrical skirt of the cap with an outwardly projecting bead;

providing the cup-shaped shell with an inwardly projecting recess on an interior surface thereof; and inserting the perimetrical skirt of the cap into the open end of the shell to bring the bead of the skirt of the cap within the inwardly projecting recess of the shell in an interference fit;

wherein said cap is formed of a heat sealable thermoplastic material and wherein said shell is formed of a heat sealable thermoplastic material, and further comprising:

heat sealing the cap and the shell to one another after the perimetrical wall of the cap is inserted into the open end of the shell.

* * * * *